US007380311B2

(12) United States Patent
Chen

(10) Patent No.: US 7,380,311 B2
(45) Date of Patent: Jun. 3, 2008

(54) FOLDABLE ARTICULATION FOR PLAYPEN

(76) Inventor: Owen Chen, 284, Min Chuan West Rd., Tatung, Taipei (TW)

( * ) Notice: Subject to any disclaimer, the term of this patent is extended or adjusted under 35 U.S.C. 154(b) by 239 days.

(21) Appl. No.: 11/247,883

(22) Filed: Oct. 11, 2005

(65) Prior Publication Data

US 2007/0079441 A1 Apr. 12, 2007

(51) Int. Cl.
*E05D 11/10* (2006.01)

(52) U.S. Cl. ..... 16/326; 5/99.1

(58) Field of Classification Search ..... 16/370, 16/347, 348, 360, 326; 5/99.1, 93.1, 98.1, 5/98.2, 110, 111, 102, 99.1 X; 403/100, 403/102, 325

See application file for complete search history.

(56) References Cited

U.S. PATENT DOCUMENTS 5,293,656 A * 3/1994 Chan ..... 5/99.1
5,483,710 A * 1/1996 Chan ..... 5/99.1
5,611,634 A * 3/1997 Wang ..... 403/102
5,730,542 A * 3/1998 Cheng ..... 403/102
5,745,954 A * 5/1998 Shogan et al. ..... 16/343
5,781,944 A * 7/1998 Huang ..... 5/99.1
6,202,229 B1 * 3/2001 Cheng ..... 5/99.1
6,915,545 B2 * 7/2005 Chen ..... 16/297

FOREIGN PATENT DOCUMENTS

FR 2886824 A3 * 12/2006

* cited by examiner

*Primary Examiner*—Chuck Y. Mah
(74) *Attorney, Agent, or Firm*—Alan Kamrath; Kamrath & Associates PA

(57) ABSTRACT

A foldable articulation for a playpen includes a mounting seat, two pivot rods pivotally mounted on two opposite ends of the mounting seat, and a folding device mounted on the mounting seat and releasably rested on each of the two pivot rods. Thus, the articulation is operated to fold the playpen when not in use, thereby saving the space of storage. In addition, a user only needs to press the press member of the folding device to fold the articulation, so that the user's one hand will not be inserted into the inside of the mounting seat, thereby preventing the user's one hand from being clamped so as to protect the user's safety.

12 Claims, 5 Drawing Sheets

FOLDABLE ARTICULATION FOR PLAYPEN

BACKGROUND OF THE INVENTION

1. Field of the Invention

The present invention relates to a foldable articulation, and more particularly to a foldable articulation for a playpen.

2. Description of the Related Art

A conventional foldable articulation for a playpen comprises a base, a press block and two support seats. The foldable articulation is pivotally mounted between any two support rods of the playpen, so that the playpen can be expanded and folded by operation of the foldable articulation. However, the folding angle of the support rods is not limited, so that when the user exerts a force on the support rods to fold the support rods, the user's fingers are easily clamped and hurt.

Another conventional foldable articulation for a playpen was disclosed in the Taiwanese Patent Application No. 00261742 and comprises an inner mounting block, an outer mounting block, a slide and a plurality springs. The foldable articulation is mounted between any two support rods of the playpen, so that the playpen can be expanded and folded by operation of the foldable articulation. However, such a conventional foldable articulation has a complicated construction, thereby increasing costs of fabrication, and thereby causing inconvenience to a user when assembling the playpen.

SUMMARY OF THE INVENTION

In accordance with the present invention, there is provided a foldable articulation, comprising a mounting seat, two pivot rods pivotally mounted on two opposite ends of the mounting seat, and a folding device mounted on the mounting seat and releasably rested on each of the two pivot rods.

The primary objective of the present invention is to provide a foldable articulation for a playpen, wherein the articulation is operated to fold the playpen when not in use, thereby saving the space of storage.

Another objective of the present invention is to provide a foldable articulation for a playpen, wherein a user only needs to press the press member of the folding device to fold the articulation, so that the user's fingers will not be inserted into the inside of the mounting seat, thereby preventing the user's fingers from being clamped so as to protect the user's safety.

A further objective of the present invention is to provide a foldable articulation for a playpen, wherein the articulation is folded and expanded easily and rapidly, thereby facilitating the user operating the articulation.

Further benefits and advantages of the present invention will become apparent after a careful reading of the detailed description with appropriate reference to the accompanying drawings.

DETAILED DESCRIPTION OF THE INVENTION

Figure 1:
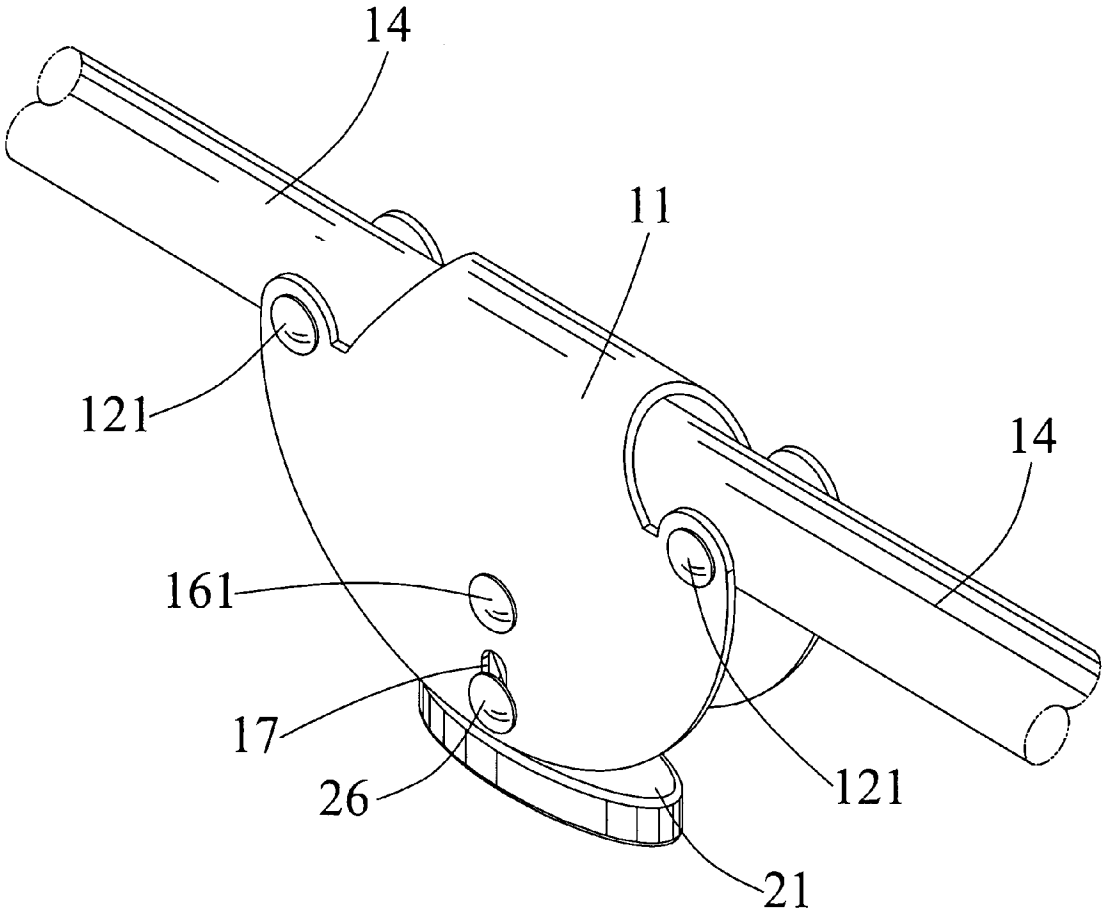
FIG. 1 is a perspective view of a foldable articulation for a playpen in accordance with the preferred embodiment of the present invention.
Figure 2:
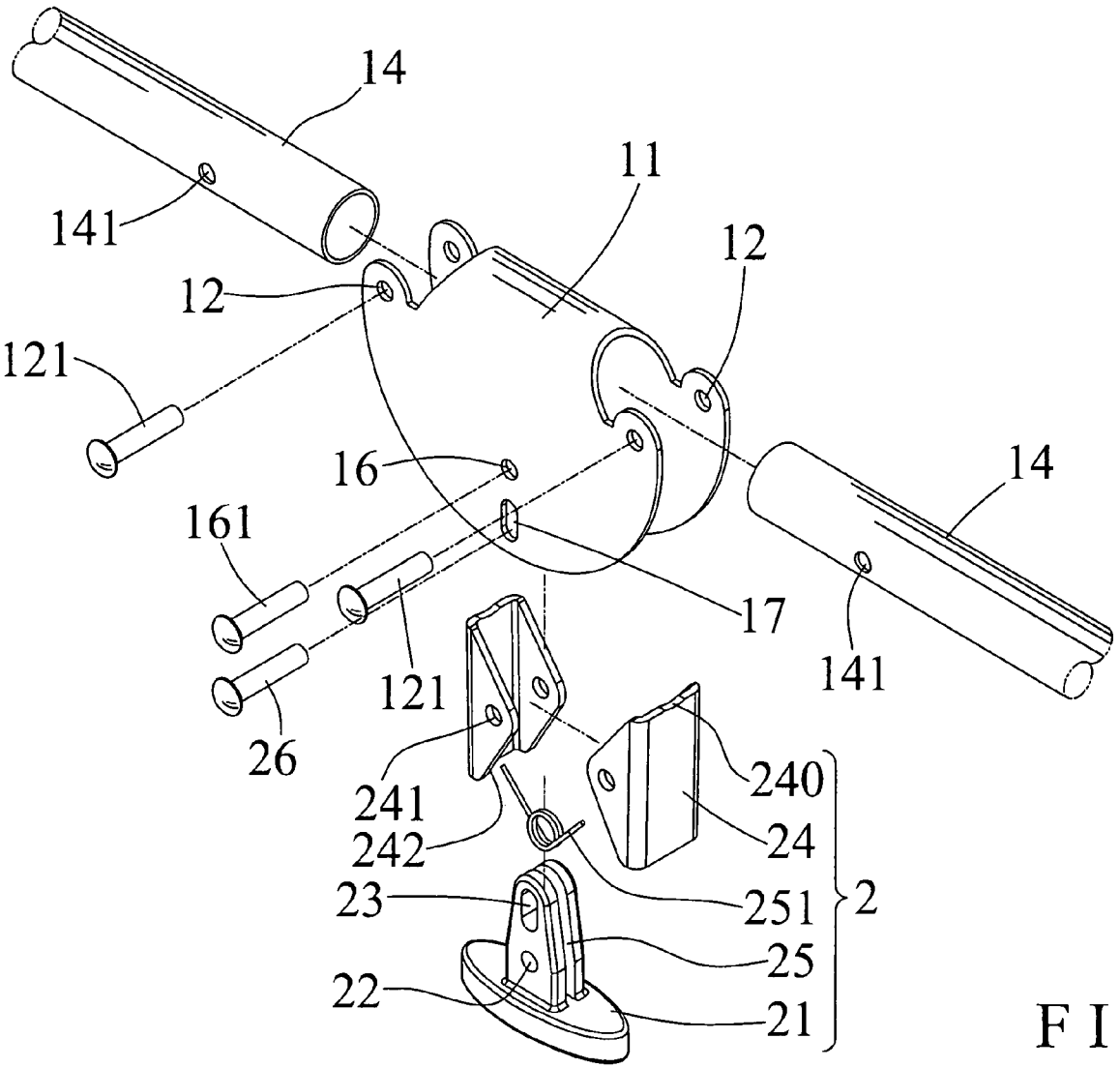
FIG. 2 is an exploded perspective view of the foldable articulation as shown in FIG. 1.
Figure 3:
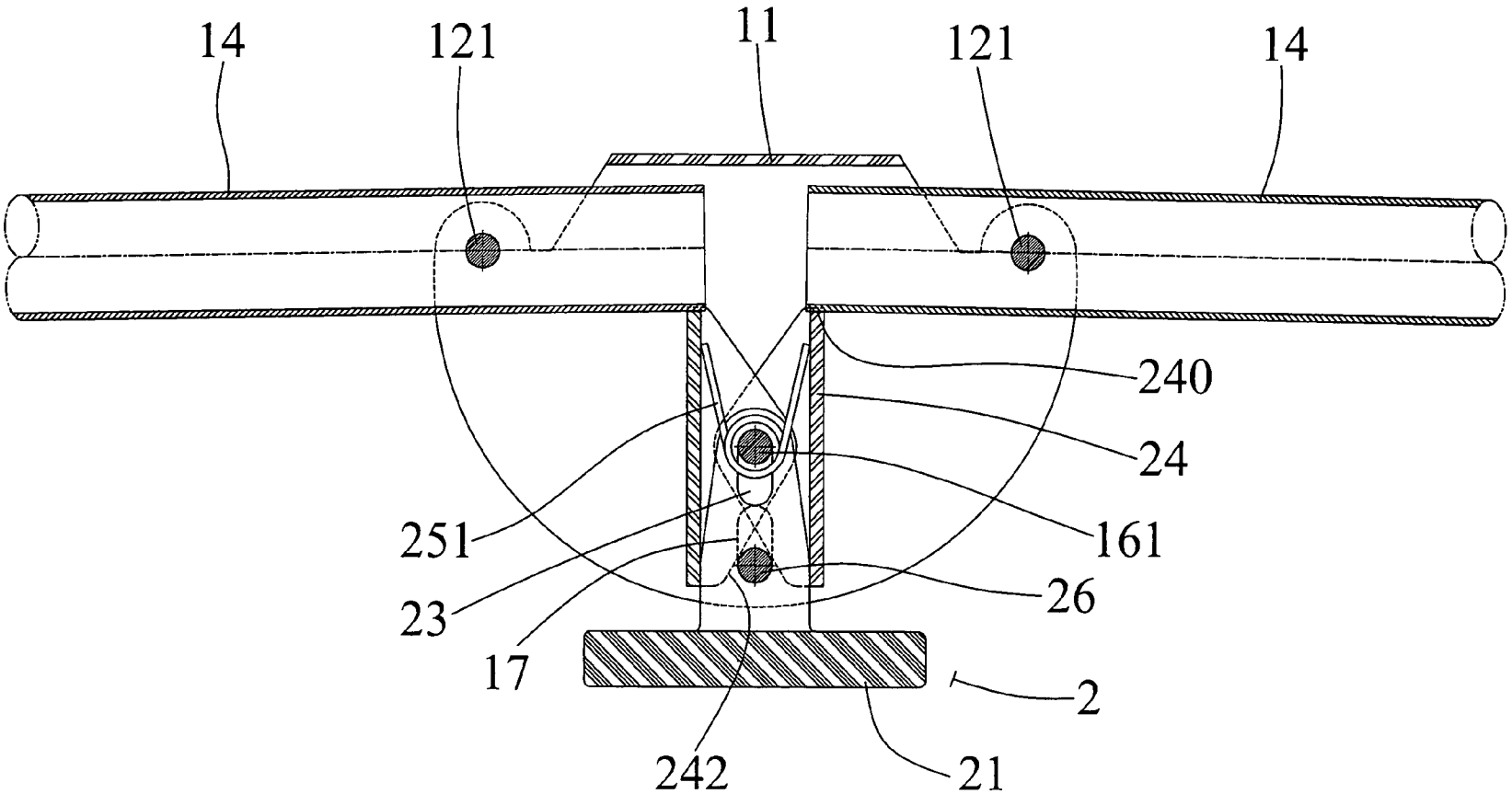
FIG. 3 is a plan cross-sectional view of the foldable articulation as shown in FIG. 1.

Referring to the drawings and initially to FIGS. 1-3, a foldable articulation for a playpen in accordance with the preferred embodiment of the present invention comprises a mounting seat 11, two pivot rods 14 pivotally mounted on two opposite ends of the mounting seat 11, and a folding device 2 mounted on the mounting seat 11 and releasably rested on each of the two pivot rods 14.

The folding device 2 is operable between a first position where the folding device 2 is rested on each of the two pivot rods 14 to secure the two pivot rods 14 to the mounting seat 11 and a second position where the folding device 2 is detached from each of the two pivot rods 14 so that each of the two pivot rods 14 is pivotable relative to the mounting seat 11.

The folding device 2 includes two locking members 24 each pivotally mounted in the mounting seat 11 and each having a first end 240 detachably rested on a respective one of the two pivot rods 14, a press member 21 movably mounted between the two locking members 24, a push member 26 secured on the press member 21 to move therewith and rested on a second end 242 of each of the two locking members 24, and an elastic member 251 mounted on the press member 21 and biased between the first ends 240 of the two locking members 24 to provide a restoring force to the two locking members 24.

The two locking members 24 laminate each other to encompass the press member 21. Each of the two locking members 24 has two substantially triangular side walls. Each of the two locking members 24 has a mediate portion pivotally mounted in the mounting seat 11 and formed with a pivot hole 241. The second end 242 of each of the two locking members 24 is a ramp rested on the push member 26. Thus, when the second end 242 of each of the two locking members 24 is pushed by the push member 26 to move outward relative to the mounting seat 11, the two locking members 24 are pivoted relative to the mounting seat 11 so that the first end 240 of each of the two locking members 24 is moved inward relative to the mounting seat 11 to detach from the respective pivot rod 14.

The press member 21 is a substantially inverted T-shaped block. The press member 21 is protruded outward from the mounting seat 11. The press member 21 has an inside formed with groove 25 to receive the elastic member 251. The press member 21 has a first portion formed with a fixing hole 22 mounted on the push member 26 and a second portion formed with an elongated guide slot 23.

The elastic member 251 is a substantially V-shaped torsion spring and has two legs each urged on the first end 240 of the respective locking member 24.

The mounting seat 11 has a substantially saddle shape and has two substantially semi-circular side walls. The mounting seat 11 has a mediate portion formed with an elongated guide slot 17 and a fixing bore 16. The push member 26 is slidably mounted in the guide slot 17 of the mounting seat 11. Each of the two opposite ends of the mounting seat 11 is formed with a through hole 12.

Each of the two pivot rods 14 is formed with a pivot hole 141, and the foldable articulation further comprises two pivot shafts 121 each extended through the respective through hole 12 of the mounting seat 11 and the pivot hole 141 of a respective one of the two pivot rods 14 so that each of the two pivot rods 14 is pivotally mounted on the mounting seat 11.

In addition, the foldable articulation further comprises a pivot axle 161 extended through the fixing bore 16 of the mounting seat 11, the pivot hole 241 of each of the two locking members 24 and the guide slot 23 of the press member 21, so that the two locking members 24 are pivotable about the pivot axle 161, and the press member 21 is movable on the pivot axle 161. The pivot axle 161 is also extended through the elastic member 251 so that the elastic member 251 is pivotable about the pivot axle 161.

As shown in FIG. 3, the first end 240 of each of the two locking members 24 is rested on the respective pivot rod 14 so that each of the two pivot rods 14 is secured to the mounting seat 11 by the two locking members 24.

Figure 4:
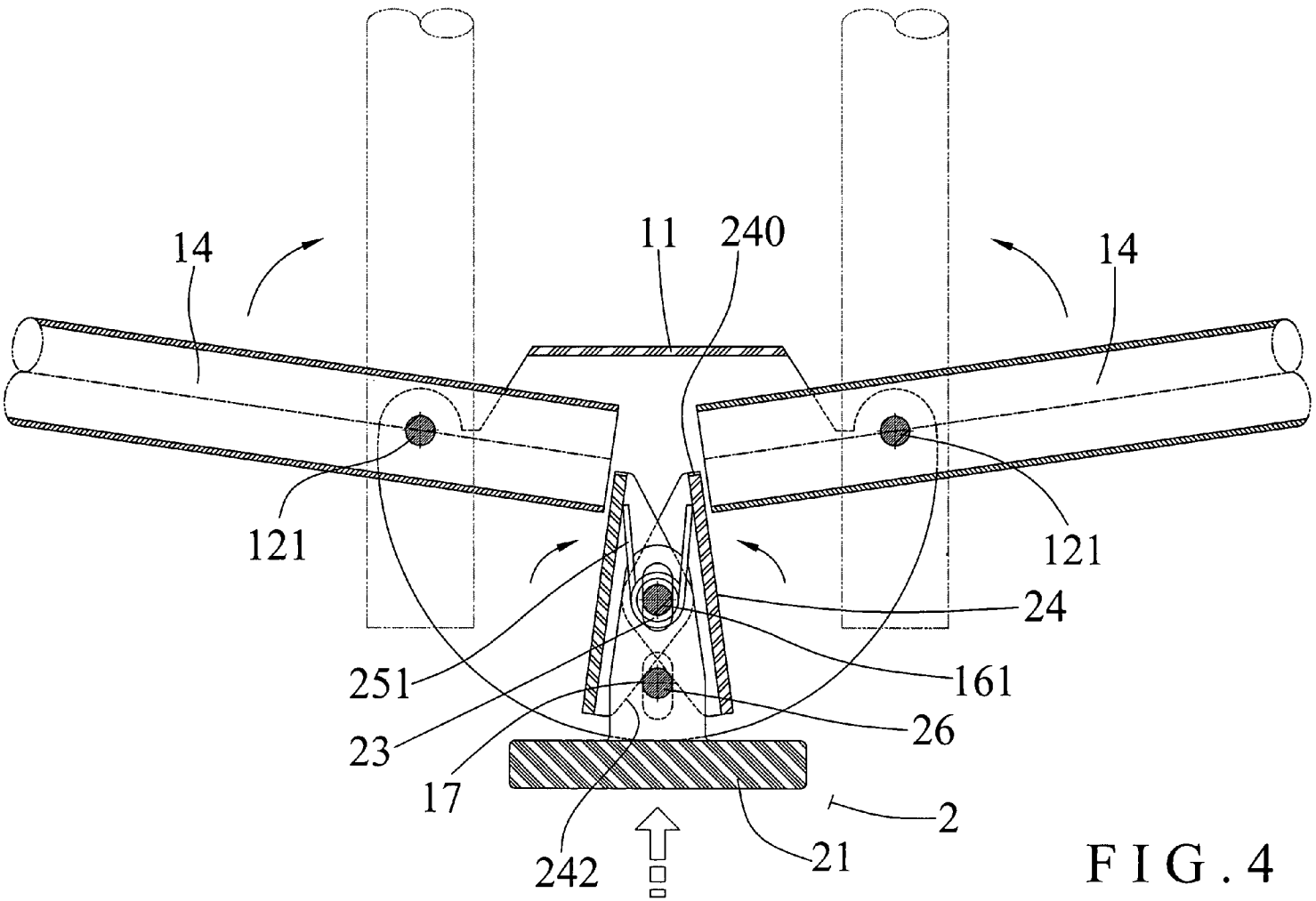
FIG. 4 is a schematic operational view of the foldable articulation as shown in FIG. 3.

As shown in FIG. 4, when the press member 21 is pressed upward, the push member 26 is moved upward to push the second end 242 of each of the two locking members 24. In such manner, the second ends 242 of the two locking members 24 are pushed by the push member 26 to move outward relative to each other, so that the first ends 240 of the two locking members 24 are moved inward relative to each other to detach from the pivot rods 14. At this time, the elastic member 251 is compressed by the first ends 240 of the two locking members 24. Thus, the two pivot rods 14 are released from the two locking members 24 and can be pivoted relative to the mounting seat 11.

Figure 5:
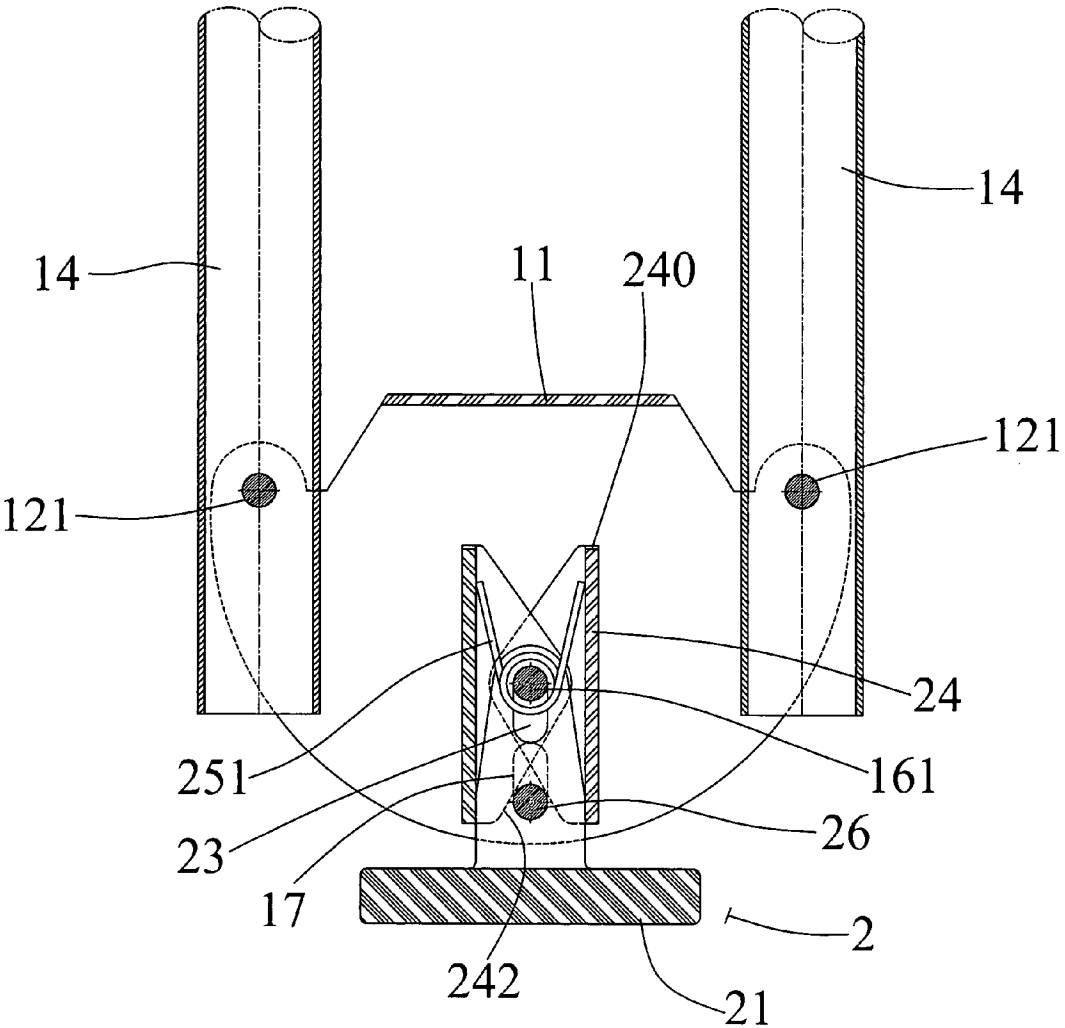
FIG. 5 is a schematic operational view of the foldable articulation as shown in FIG. 4.

As shown in FIG. 5, the two pivot rods 14 are pivoted upward relative to the mounting seat 11, thereby folding the articulation of the playpen. At this time, the first ends 240 of the two locking members 24 are pushed by the elastic member 251 to move outward relative to each other, thereby pivoting and restoring the two locking members 24 to the original position as shown in FIG. 3.

Accordingly, the articulation is operated to fold the playpen when not in use, thereby saving the space of storage. In addition, a user only needs to press the press member 21 of the folding device 2 to fold the articulation, so that the user's fingers will not be inserted into the inside of the mounting seat 11, thereby preventing the user's fingers from being clamped so as to protect the user's safety. Further, the articulation is folded and expanded easily and rapidly, thereby facilitating the user operating the articulation.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A foldable articulation, comprising:

a mounting seat;

two pivot rods pivotally mounted on two opposite ends of the mounting seat;

a folding device mounted on the mounting seat and releasably rested on each of the two pivot rods;

wherein the folding device includes:

two locking members each pivotally mounted in the mounting seat and each having a first end detachably rested on a respective one of the two pivot rods;

a press member movably mounted between the two locking members;

a push member secured on the press member to move therewith and rested on a second end of each of the two locking members;

the press member has a first portion formed with a fixing hole through which the push member is extended;

the two locking members are pivotally connected with each other;

the second ends of the two locking members intersect mutually, and the push member abuts the second ends of the two locking members to press the second ends of the two locking members to move outward relative to each other so that the first ends of the two locking members are movable toward each other and are detachable from the pivot rods so as to fold the pivot rods;

the mounting seat has a mediate portion formed with a fixing bore, each of the two locking members has a mediate portion pivotally mounted in the mounting seat and formed with a pivot hole, the press member has a second portion formed with an elongated guide slot, and the foldable articulation further comprises a pivot axle extended through the fixing bore of the mounting seat, the pivot hole of each of the two locking members and the guide slot of the press member, so that the two locking members are pivotally connected by the pivot axle and are pivotable about the pivot axle, and the press member is movable on the pivot axle;

when the second end of each of the two locking members is pushed by the push member to move outward relative to the mounting seat, the two locking members are pivoted relative to the mounting seat so that the first end of each of the two locking members is moved inward relative to the mounting seat to detach from the respective pivot rod;

when the press member is pressed upward, the push member is moved upward to push the second end of each of the two locking members, so that the second ends of the two locking members are pushed by the push member to move outward relative to each other, and the first ends of the two locking members are moved inward relative to each other to detach from the pivot rods.

2. The foldable articulation in accordance with claim 1, wherein the two locking members intersect and laminate each other to encompass an outside of the press member which is partially hidden between the two locking members.

3. The foldable articulation in accordance with claim 1, wherein the two locking members are located outside of the press member, and each of the two locking members has two substantially triangular side walls intersecting each other.

4. The foldable articulation in accordance with claim 1, wherein the second end of each of the two locking members is a ramp provided on an inner face of each of the two locking members and rested on the push member, and the ramps of the two locking members face and intersect each other.

5. The foldable articulation in accordance with claim 1, wherein the press member is a substantially inverted T-shaped block.

6. The foldable articulation in accordance with claim 1, wherein the press member is protruded outward from the mounting seal.

7. The foldable articulation in accordance with claim 1, wherein the folding device further includes an elastic member mounted on the press member and biased between the first ends of the two locking members to provide a restoring force to the two locking members to push the first ends of the two locking members to move outward relative to each other.

8. The foldable articulation in accordance with claim 7, wherein the elastic member is a substantially V-shaped torsion spring and has two legs each urged on an inner face of the first end of the respective locking member.

9. The foldable articulation in accordance with claim 7, wherein the press member has an inside formed with a groove to receive the elastic member.

10. The foldable articulation in accordance with claim 7, wherein the pivot axle is extended through the elastic member so that the elastic member is pivotable about the pivot axle.

11. The foldable articulation in accordance with claim 1, wherein the mounting seat has a substantially saddle shape and has two substantially semi-circular side walls parallel with each other.

12. The foldable articulation in accordance with claim 1, wherein the mounting seat has a mediate portion formed with an elongated guide slot, and the push member is extended through the fixing hole of the press member and is slidably mounted in the guide slot of the mounting seat to move the press member.

* * * * *